US008132393B2

(12) United States Patent
De Luca et al.

(10) Patent No.: US 8,132,393 B2
(45) Date of Patent: Mar. 13, 2012

(54) RADIAL COMPRESSION SYSTEM FOR ROLLS OF MATERIAL AND ASSOCIATED METHOD

(75) Inventors: Nicholas P. De Luca, Washington, DC (US); Robert H. Brill, Arnold, MD (US)

(73) Assignee: Sealed Air Corporation

( * ) Notice: Subject to any disclaimer, the term of this patent is extended or adjusted under 35 U.S.C. 154(b) by 211 days.

(21) Appl. No.: 12/396,883

(22) Filed: Mar. 3, 2009

(65) Prior Publication Data

US 2009/0223389 A1 Sep. 10, 2009

Related U.S. Application Data

(60) Provisional application No. 61/033,773, filed on Mar. 4, 2008.

(51) Int. Cl.
*B65B 13/20* (2006.01)
*B65B 63/02* (2006.01)

(52) U.S. Cl. ..... 53/438; 53/436; 53/529

(58) Field of Classification Search ..... 53/436, 53/438, 529; 242/597, 597.7; 100/3, 35, 100/42, 232

See application file for complete search history.

(56) References Cited

U.S. PATENT DOCUMENTS

| | | | | | |
|---|---|---|---|---|---|
| 864,975 | A | * | 9/1907 | Luoe | 206/417 |
| 1,048,558 | A | * | 12/1912 | Markiewioz | 242/597 |
| 2,819,834 | A | | 1/1958 | Brady | |
| 3,349,991 | A | | 10/1967 | Kessler | |
| 3,537,226 | A | | 11/1970 | Le Van et al. | |
| 3,587,201 | A | | 6/1971 | Strayer | |
| 3,599,388 | A | | 8/1971 | Feingold | |
| 3,670,954 | A | | 6/1972 | Leventhal | |
| 3,674,135 | A | | 7/1972 | Simon | |
| 3,751,008 | A | * | 8/1973 | McNatt | 254/134 |
| 3,784,087 | A | | 1/1974 | Styers | |
| 3,910,145 | A | | 10/1975 | Bender et al. | |
| 3,936,890 | A | | 2/1976 | Oberstein | |
| 4,294,875 | A | | 10/1981 | Schramm | |
| 4,341,056 | A | | 7/1982 | Leanna et al. | |
| 4,369,929 | A | | 1/1983 | Cayer | |
| 4,419,087 | A | | 12/1983 | Herrington | |
| 4,444,311 | A | | 4/1984 | Rias | |
| 4,535,587 | A | * | 8/1985 | Rias | 53/436 |
| 4,553,668 | A | | 11/1985 | James et al. | |
| 4,595,093 | A | | 6/1986 | Eckstein | |

(Continued)

FOREIGN PATENT DOCUMENTS

DE 41 06 972 9/1991

(Continued)

*Primary Examiner* — Rinaldi Rada
*Assistant Examiner* — Gloria R Weeks
(74) *Attorney, Agent, or Firm* — Alston & Bird LLP

(57) ABSTRACT

Apparatus and methods for compressing at least one roll of compressible material having an outer diameter and a circumference and an inner core having an inner diameter at least one roll of compressible material are provided. For example, a method according to one embodiment includes positioning a chuck about the circumference of the at least one roll, wherein the chuck is configured to engage the at least one roll at a plurality of evenly spaced locations about the circumference of the at least one roll. The method further includes radially compressing the at least one roll at a plurality of evenly spaced locations about the circumference of the at least one roll with the chuck such that the outer diameter of the at least one roll is substantially uniformly reduced without collapsing the inner core.

18 Claims, 9 Drawing Sheets

U.S. PATENT DOCUMENTS

Figure 2A:
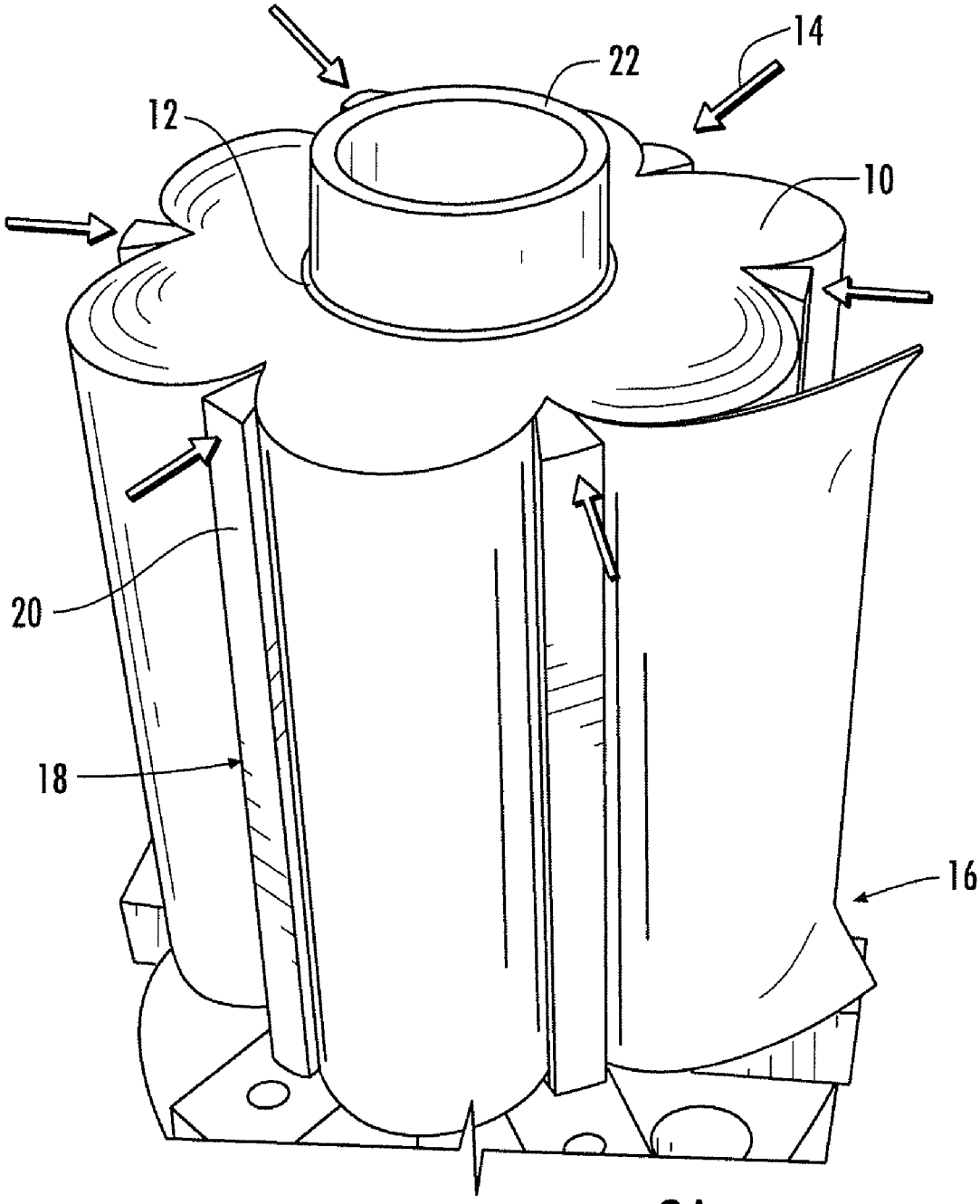

| | | | | |
|---|---|---|---|---|
| 4,630,311 | A | 12/1986 | Bentson | |
| 4,637,812 | A | 1/1987 | Ogawa | |
| 4,653,252 | A | 3/1987 | van de Haar et al. | |
| 4,679,379 | A | 7/1987 | Cassoli | |
| 4,762,061 | A | 8/1988 | Watanabe et al. | |
| 4,859,083 | A | 8/1989 | Nocek et al. | |
| 4,886,167 | A | 12/1989 | Dearwester | |
| 4,909,388 | A | 3/1990 | Watanabe | |
| 4,911,560 | A | 3/1990 | Hoover et al. | |
| 5,027,582 | A | 7/1991 | Dearwester | |
| 5,038,549 | A * | 8/1991 | Nordstrom | 53/447 |
| 5,064,072 | A | 11/1991 | Nakamura | |
| 5,177,934 | A | 1/1993 | Yamamoto | |
| 5,186,099 | A | 2/1993 | Qing et al. | |
| 5,195,300 | A | 3/1993 | Kovacs et al. | |
| 5,205,808 | A | 4/1993 | Gebhardt | |
| 5,209,352 | A | 5/1993 | Light et al. | |
| 5,331,788 | A * | 7/1994 | Cinotti | 53/228 |
| RE34,929 | E | 5/1995 | Kristen | |
| 5,468,206 | A | 11/1995 | Buchanan | |
| 5,518,313 | A | 5/1996 | McAdam | |
| 5,685,428 | A | 11/1997 | Herbers et al. | |
| D389,350 | S | 1/1998 | Davis et al. | |
| 5,743,397 | A | 4/1998 | Traver | |
| 5,788,136 | A * | 8/1998 | Othman | 225/79 |
| 5,882,118 | A | 3/1999 | Daniels et al. | |
| 5,894,708 | A | 4/1999 | Newby | |
| 6,061,999 | A | 5/2000 | Wingert | |
| RE36,876 | E | 9/2000 | Daniels et al. | |
| 6,254,521 | B1 | 7/2001 | Pansier et al. | |
| 6,263,814 | B1 | 7/2001 | O'Connor | |
| 6,321,513 | B1 | 11/2001 | Meixner | |
| 6,488,222 | B1 | 12/2002 | West et al. | |
| 6,527,445 | B2 | 3/2003 | LaFleur et al. | |
| 6,561,963 | B2 | 5/2003 | Totani | |
| 6,776,368 | B1 * | 8/2004 | Duncan et al. | 242/597.7 |
| 6,793,097 | B2 * | 9/2004 | Kamenstein | 221/33 |
| 6,994,246 | B2 | 2/2006 | Ichikawa et al. | |
| 7,104,031 | B2 * | 9/2006 | Baggot et al. | 53/439 |
| 7,117,655 | B2 | 10/2006 | Wells | |
| 2006/0108248 | A1 | 5/2006 | Power et al. | |
| 2007/0095693 | A1 | 5/2007 | De Luca | |

FOREIGN PATENT DOCUMENTS

| | | | |
|---|---|---|---|
| EP | 0 899 196 | A1 | 3/1999 |
| FR | 2 780 028 | | 12/1999 |
| GB | 821 371 | | 10/1959 |
| GB | 2 173 765 | | 10/1986 |
| GB | 2 244 472 | | 12/1991 |
| GB | 2 270 667 | | 3/1994 |
| JP | 47-47434 | B | 11/1972 |
| JP | 51-51151 | | 4/1976 |
| JP | 53-17575 | | 2/1978 |
| JP | 59-194722 | A | 5/1984 |
| JP | 60-52447 | A | 3/1985 |
| JP | 60-204554 | A | 10/1985 |
| JP | 60-204555 | A | 10/1985 |
| JP | 2-296633 | A | 12/1990 |
| JP | 6-30080 | U | 4/1994 |
| JP | 6-181857 | A | 7/1994 |
| JP | 3071053 | U | 7/2000 |
| JP | 3071054 | U | 7/2000 |
| JP | 2001-299632 | A | 10/2001 |
| JP | 2001-299633 | A | 10/2001 |

* cited by examiner

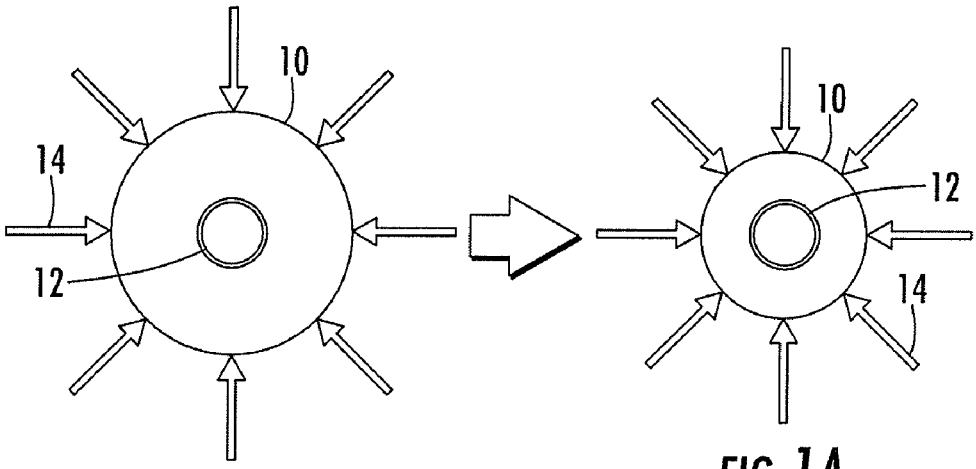
FIG. 1
FIG. 1A
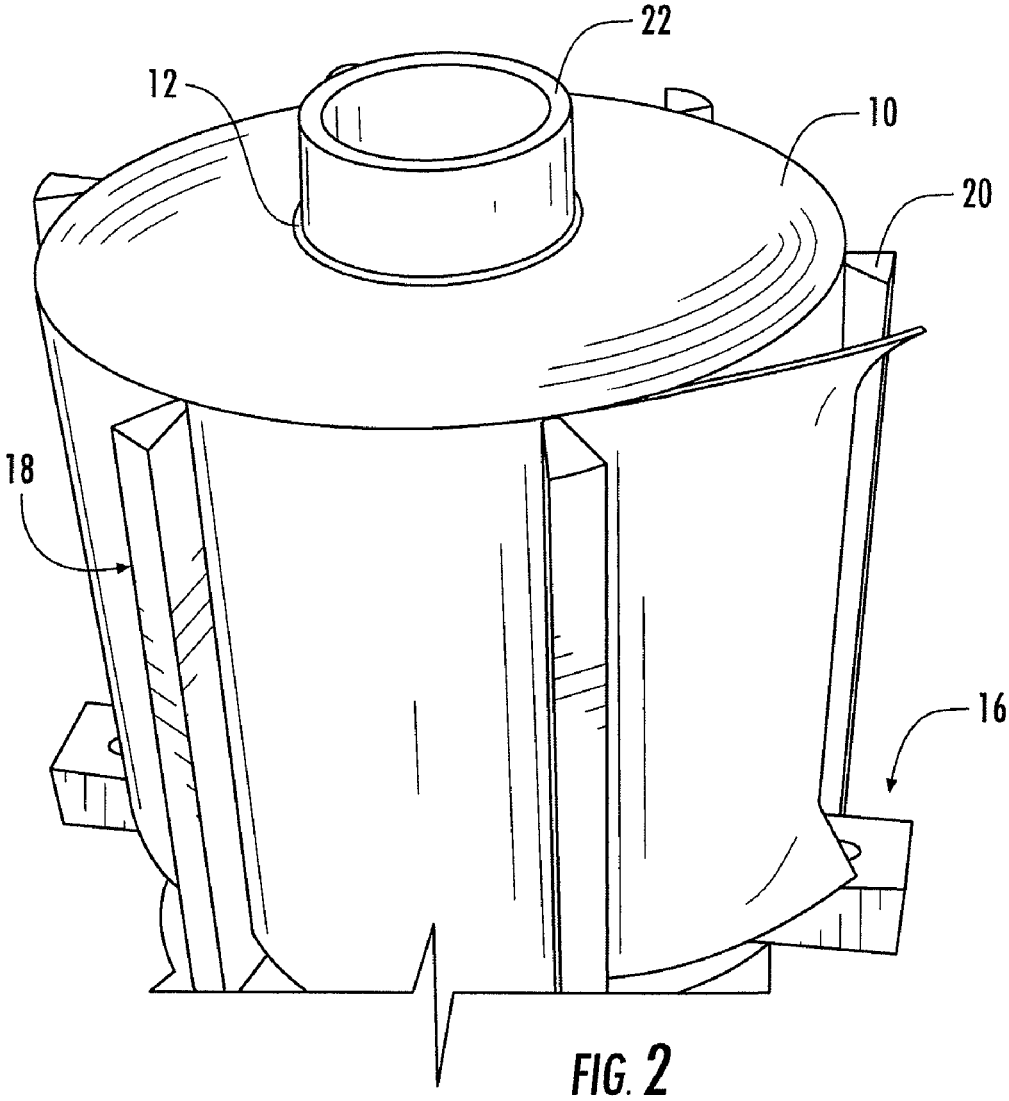
FIG. 2

RADIAL COMPRESSION SYSTEM FOR ROLLS OF MATERIAL AND ASSOCIATED METHOD

CROSS-REFERENCE TO RELATED APPLICATIONS

The present application claims priority from U.S. Provisional Application No. 61/033,773 filed Mar. 4, 2008, the contents of which are incorporated herein by reference.

BACKGROUND OF THE INVENTION

1) Field of the Invention

The present invention relates to compressed rolls of material and, more particularly, to apparatus and methods for radially and uniformly compressing one or more rolls of material.

2) Description of Related Art

The distribution of rolled paper products represents a multibillion dollar industry in the United States with one of the largest segments represented by the toilet or tissue paper segment, as well as the paper towel or kitchen towel market. The process by which both tissue and towels are made can be broken-up into two general steps. The first step involves the creation of the paper base sheet from pulp, while the second step involves converting the base sheet (from a large jumbo roll) to finished smaller roll products. While tissue is designed to be soft and degrade in septic tanks, kitchen towels are designed to be much stronger for use in absorbing spills, for use as placemats, and for cleaning.

Tissue and towels are generally made using multiple layers of base sheet. Tissue tends to have minimal glue between the layers, and generally at selected spots, while the individual plies in paper towels are generally adhered across their entire surface area. Both tissue and paper towels are embossed to create patterns which also help in strengthening the paper. The pulp drying process plays a significant role in the creation of the end product, with through air drying (TAD) producing the softest paper. Papers made using the TAD process are used to form the highest quality tissue and towel papers.

The converting machines used in the second step of the process for making both tissue and towels incorporate unwinders, embossers, rewinders, core handlers, gluers, accumulators, and log saws. Currently, these machines can produce as many as 1000 rolls of toilet paper or 400 rolls of paper towels per minute. Additional steps of wrapping, packing, and case packing are done after the log saw and are generally connected to the converting operation via conveyors.

The sales of rolled paper products occur through retail stores, bulk discount stores, and more industrial "away from home" markets. One of the major difficulties for retailers involves the disposal of boxes and other packaging used to ship the finished rolls. The inherent bulkiness of rolled paper products also requires stores to order on-demand, with the overall cycle from production to sale occurring over several days (e.g., a 45 day period). Bulkiness also limits the ability of manufacturers to set-up production facilities far from end-users, as transportation of the finished goods can be cost-prohibitive. For end-users, the purchase, transport, and storage of tissue and towels also prove difficult because of the large inherent volume.

Furthermore, tissue and towels typically include an inner core for dispensing individual rolls. Because the core of tissue and towels is generally made of paper or other collapsible material, the cores are often difficult to collapse without causing significant distortion and separation from the sheet. This may be due to the manner in which the roll is compressed, the type of core, the amount of adhesive applied to the paper when attached to the core, as well as the type of adhesive used in forming the core. Moreover, an end consumer may have difficulty in reforming the core in a manner that is usable in a standard dispenser system. Other methods for compressing rolls of paper products are incapable of compressing larger numbers of rolls or require a vacuum to package the rolls, both of which typically increase costs.

It would therefore be advantageous to provide apparatus and methods for uniformly compressing and packaging rolls of material in a compressed form. In addition, it would be advantageous to provide apparatus and methods that are economical and are capable of efficiently compressing and packaging one or more rolls of material efficiently. Furthermore, it would be advantageous to provide apparatus and methods that effectively compress the rolls of material in an aesthetically pleasing manner.

BRIEF SUMMARY OF THE INVENTION

Embodiments of the invention address the above needs and achieve other advantages by providing apparatus and methods for compressing at least one roll of compressible material having an outer diameter and a circumference and an inner core having an inner diameter. For example, a method according to one embodiment includes positioning a chuck about the circumference of the at least one roll, wherein the chuck is configured to engage the at least one roll at a plurality of evenly spaced locations about the circumference of the at least one roll. The method further includes radially compressing the at least one roll at a plurality of evenly spaced locations about the circumference of the at least one roll with the chuck such that the outer diameter of the at least one roll is substantially uniformly reduced without collapsing the core.

Aspects of the method include positioning a mandrel within the inner diameter of the core prior to compressing the at least one roll. The method may also include at least partially enclosing the at least one roll with a packaging material either before or after radially compressing the at least one roll. Enclosing the at least one roll may include circumferentially wrapping the at least one roll with a packaging material and/or at least partially enclosing the at least one roll with a heat-shrinkable film and applying heat to the heat-shrinkable film.

Additional aspects include radially compressing the outer diameter of the at least one roll with a pair of opposing forces at a plurality of radial locations evenly spaced about the circumference of the at least one roll. The method may include providing a plurality of rolls each having an outer diameter and an inner core having an inner diameter and radially compressing the plurality of rolls such that the outer diameter of each of the plurality of rolls is substantially uniformly reduced without collapsing the inner diameter of a respective core. The method may include positioning a mandrel within each core prior to radially compressing the plurality of rolls. In addition, the method may include arranging the plurality of rolls in an array of rows either before or after radially compressing the plurality of rolls.

Moreover, the method may include radially compressing the at least one roll to a volume that is at least 25% less than its original volume. The method may include radially compressing the at least one roll in a direction generally perpendicular to a longitudinal axis of the core. The method may further include radially compressing a single roll with the chuck such that each roll is independently radially compressed by the chuck.

An additional embodiment of the present invention is directed to an apparatus for compressing at least one roll of compressible material having an outer diameter and a circumference and an inner core having an inner diameter. The apparatus includes a chuck configured to engage the at least one roll at a plurality of radial locations evenly spaced about the circumference of the at least one roll and to move and radially compress the at least one roll such that the outer diameter of the at least one roll is substantially uniformly reduced without collapsing the core. According to one aspect, the apparatus includes at least one mandrel configured to be positioned at least partially within the inner diameter of the inner core and support the inner core while the roll is radially compressed.

According to one aspect, the chuck comprises a plurality of fingers configured to engage the at least one roll at a plurality of radial locations evenly spaced about the circumference of the at least one roll and to move and radially compress the at least one roll. For example, the chuck may include at least four fingers, wherein a first pair and a second pair of fingers are configured to move and apply opposing radial forces on the at least one roll to radially compress the at least one roll. The plurality of fingers may be longitudinal and disposed generally parallel to a longitudinal axis of the at least one core. The plurality of fingers may be configured to be at least partially embedded within the at least one roll while radially compressing the at least one roll. Moreover, the plurality of fingers may be configured to radially compress the at least one roll in a direction generally perpendicular to a longitudinal axis of the core. The plurality of fingers may also be configured to engage and radially compress a single roll such that each roll is independently radially compressed by the plurality of fingers.

A further embodiment is directed to a method for compressing at least one roll of compressible material. The method includes providing at least one roll having an outer diameter and an inner core having an inner diameter and positioning a mandrel within the inner diameter of the inner core prior to compressing the at least one roll. The method also includes radially compressing the at least one roll while the mandrel is positioned within the at least one roll such that the outer diameter of the at least one roll is substantially uniformly reduced without collapsing the inner core.

Aspects of the method include at least partially enclosing the at least one roll with a packaging material either before or after radially compressing the at least one roll, such as by circumferentially wrapping the at least one roll with a packaging material. The method may include at least partially enclosing the at least one roll with a heat-shrinkable film and applying heat to the heat-shrinkable film.

The method may additionally include radially compressing the at least one roll with a pair of opposing forces at a plurality of radial locations. In addition, the method may include radially compressing the at least one roll to a volume that is at least 25% less than its original volume. The method may include radially compressing the at least one roll in a direction generally perpendicular to a longitudinal axis of the core.

According to one aspect, the method includes providing a plurality of rolls each having an outer diameter and an inner core having an inner diameter and radially compressing the plurality of rolls such that the outer diameter of each of the plurality of rolls is substantially uniformly reduced without collapsing the inner diameter of a respective core. The method may further include comprising positioning a mandrel within each core prior to radially compressing the plurality of rolls. Moreover, the method may include arranging the plurality of rolls in an array of rows either before or after radially compressing the plurality of rolls.

An additional embodiment is directed to an apparatus for compressing at least one roll of compressible material having an outer diameter and a circumference and an inner core having an inner diameter. The apparatus includes a chuck configured to move and radially compress the at least one roll such that the outer diameter of the roll is substantially uniformly reduced without collapsing the inner diameter of the inner core. The apparatus also includes at least one mandrel configured to be positioned at least partially within the inner diameter of the inner core and to support the core while the at least one roll is radially compressed.

According to one aspect, the chuck is configured to be positioned about the circumference of the at least one roll and engage the at least one roll at a plurality of evenly spaced locations about the circumference of the at least one roll. The chuck may be configured to radially compress the at least one roll in a direction generally perpendicular to a longitudinal axis of the core. The apparatus may also include a plurality of chucks configured to radially compress a plurality of rolls of material and/or a plurality of mandrels each configured to be positioned within a respective inner core. Each of the plurality of chucks may be configured to be positioned about a respective roll and configured to move and radially compress a respective roll. Each chuck may be configured to radially compress a respective roll independently. Furthermore, the plurality of chucks and mandrels may be configured to move such that the plurality of rolls are positioned adjacent to one another in an array of rows.

BRIEF DESCRIPTION OF THE SEVERAL VIEWS OF THE DRAWING(S)

Figure 2B:
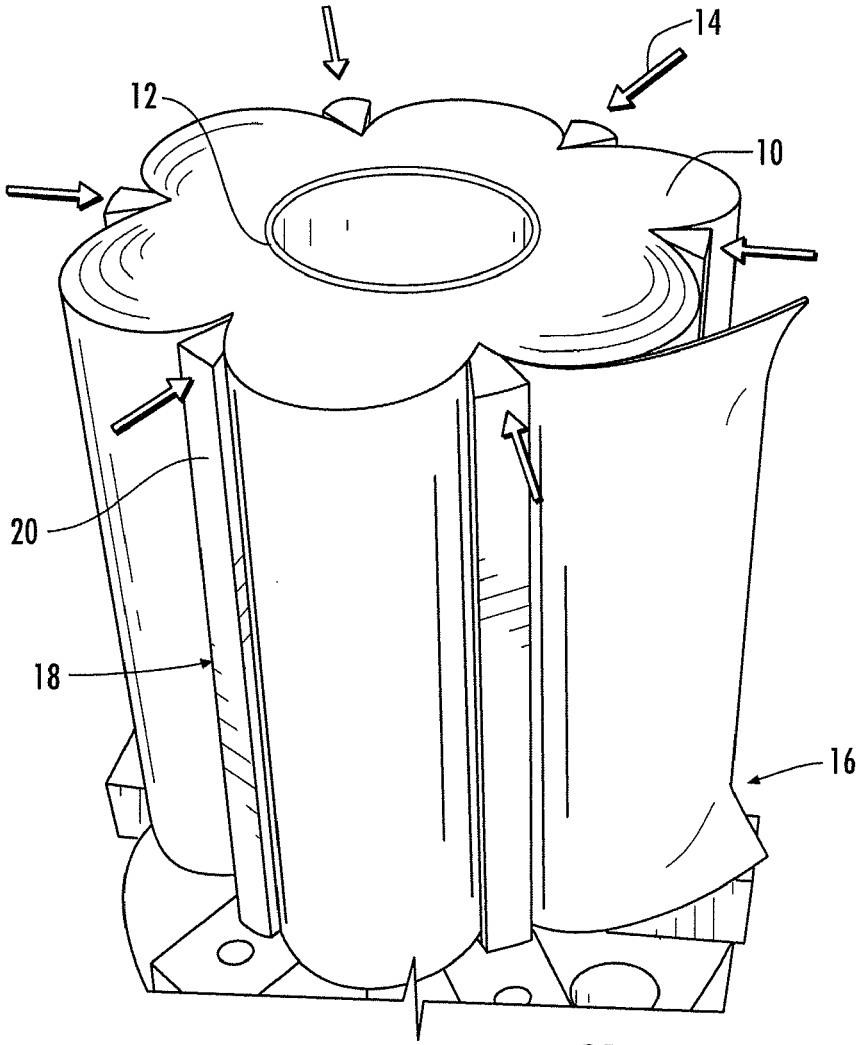
Figure 2C:
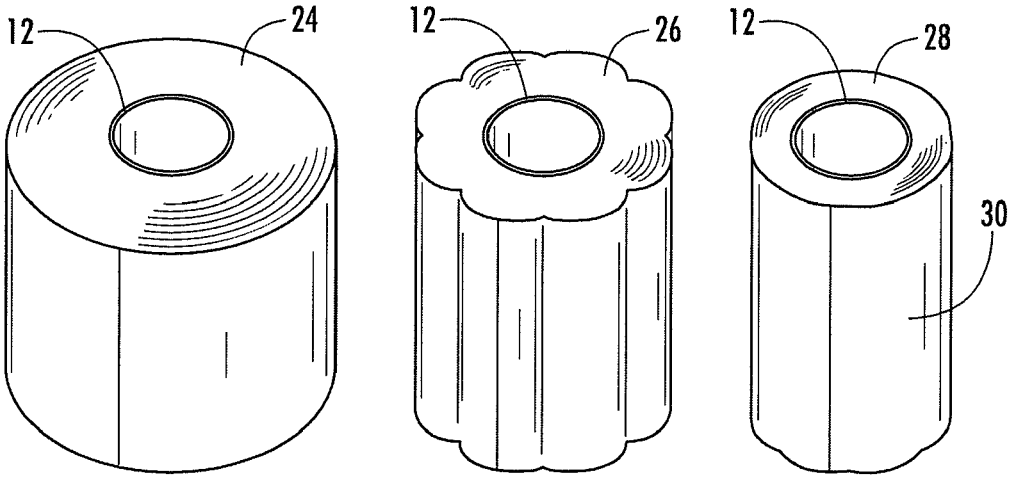
Figure 3:
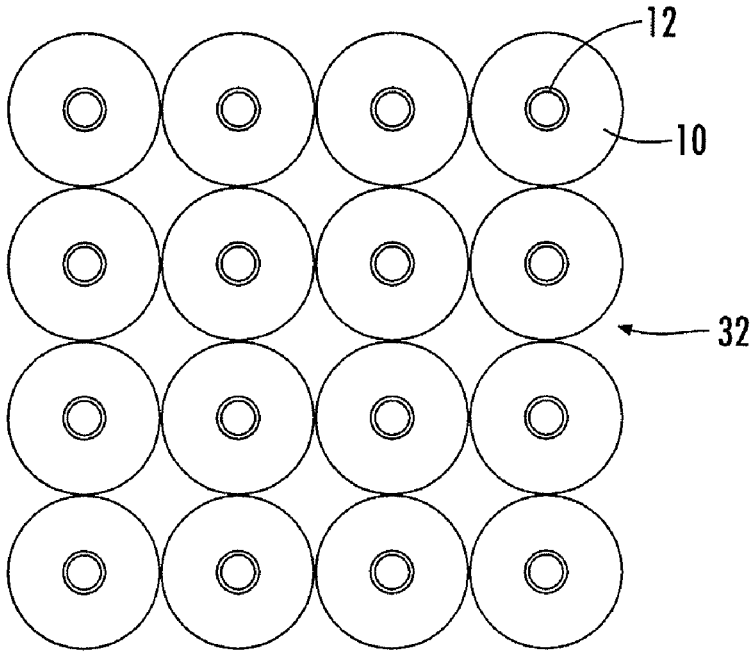
Figure 3A:
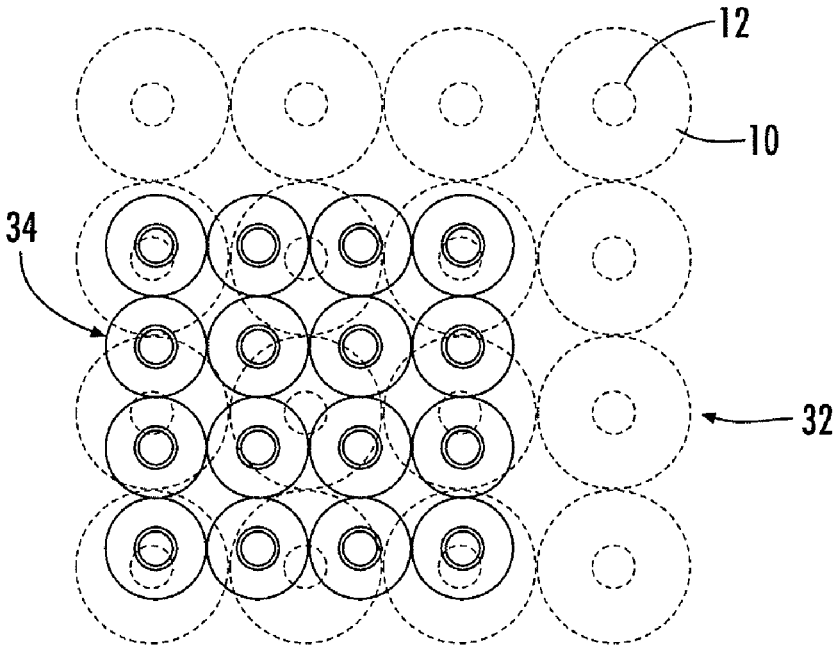
Figure 4:
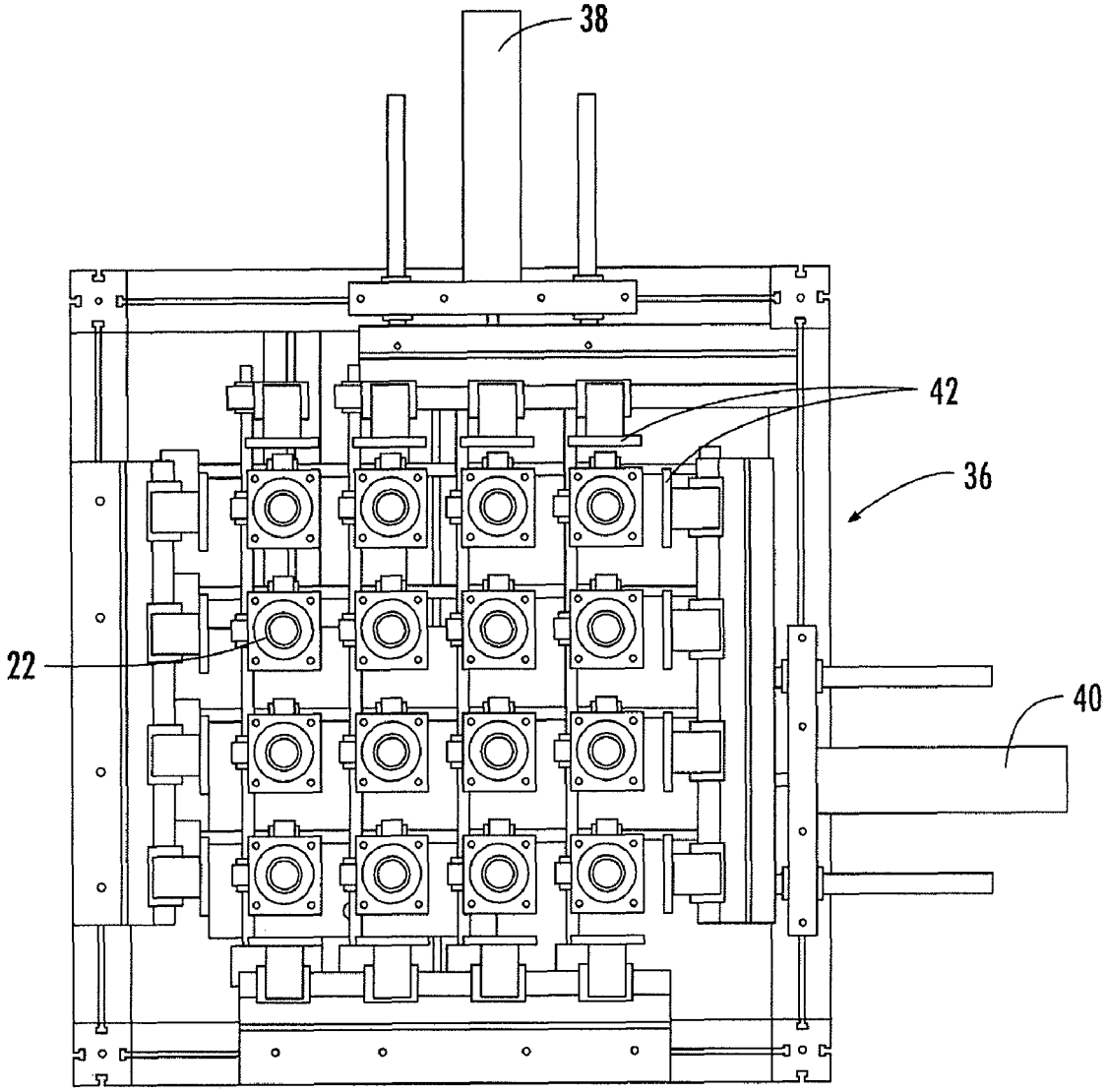
Figure 4A:
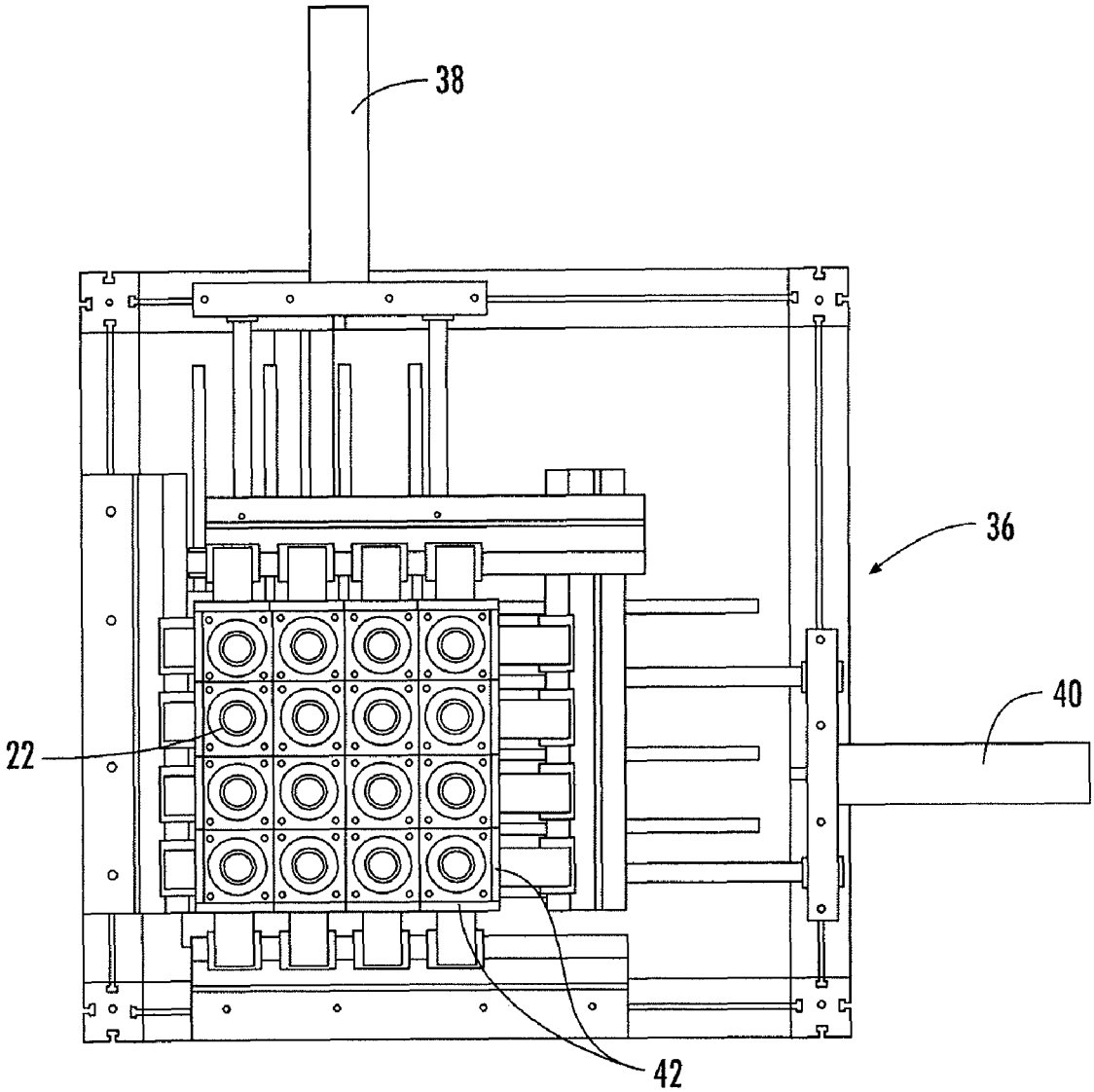
Figure 4B:
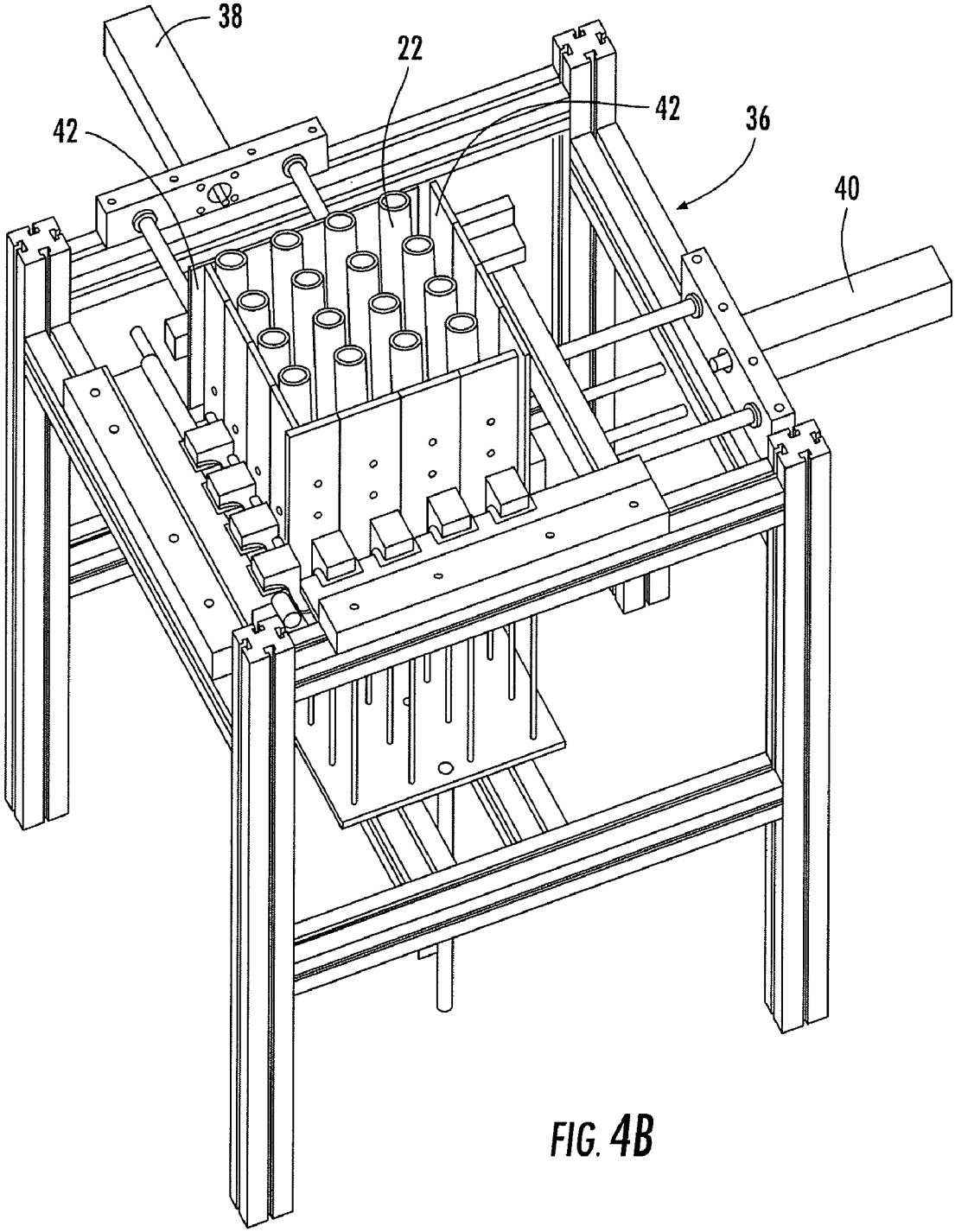
Figure 5:
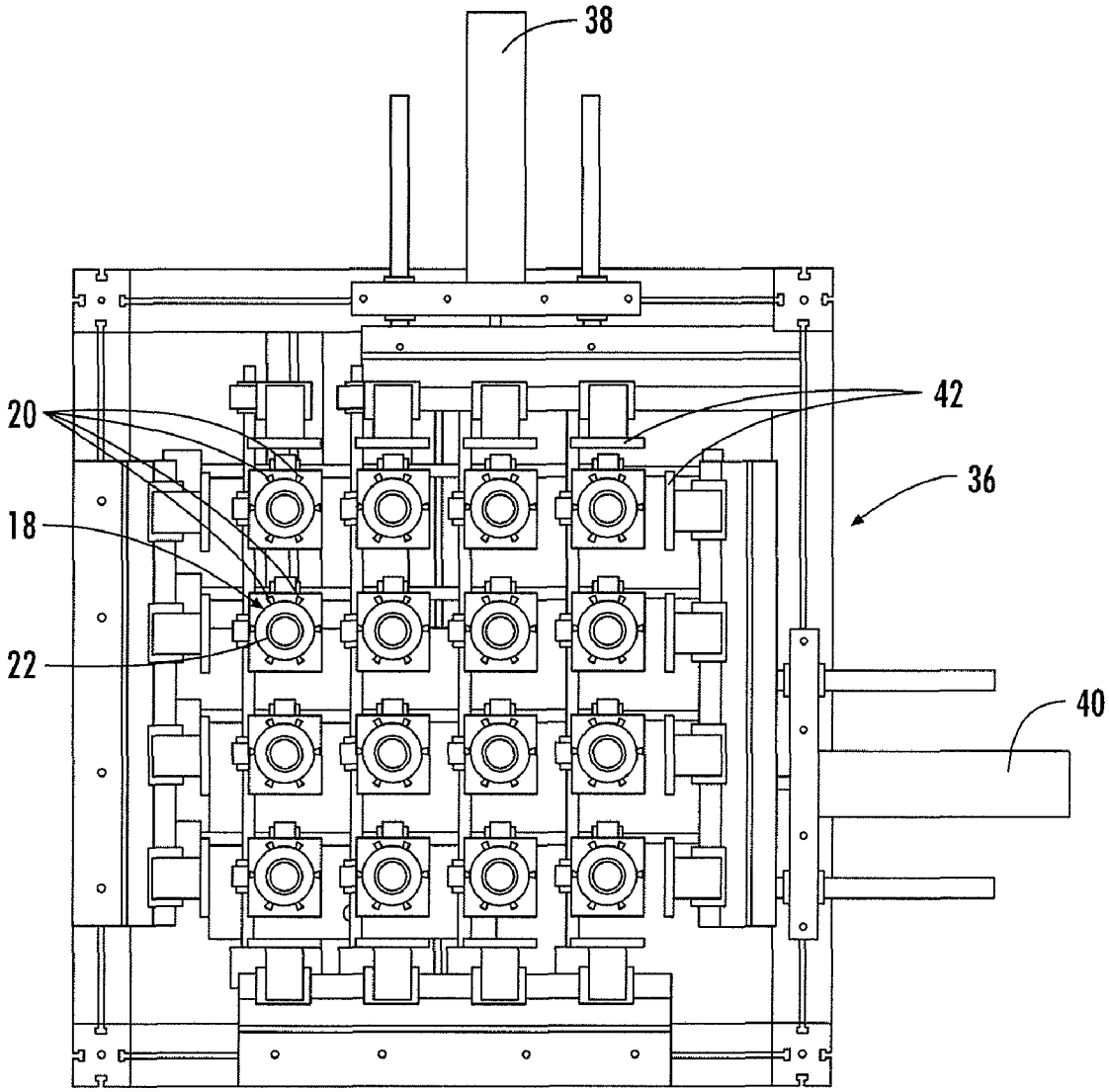
Figure 6:
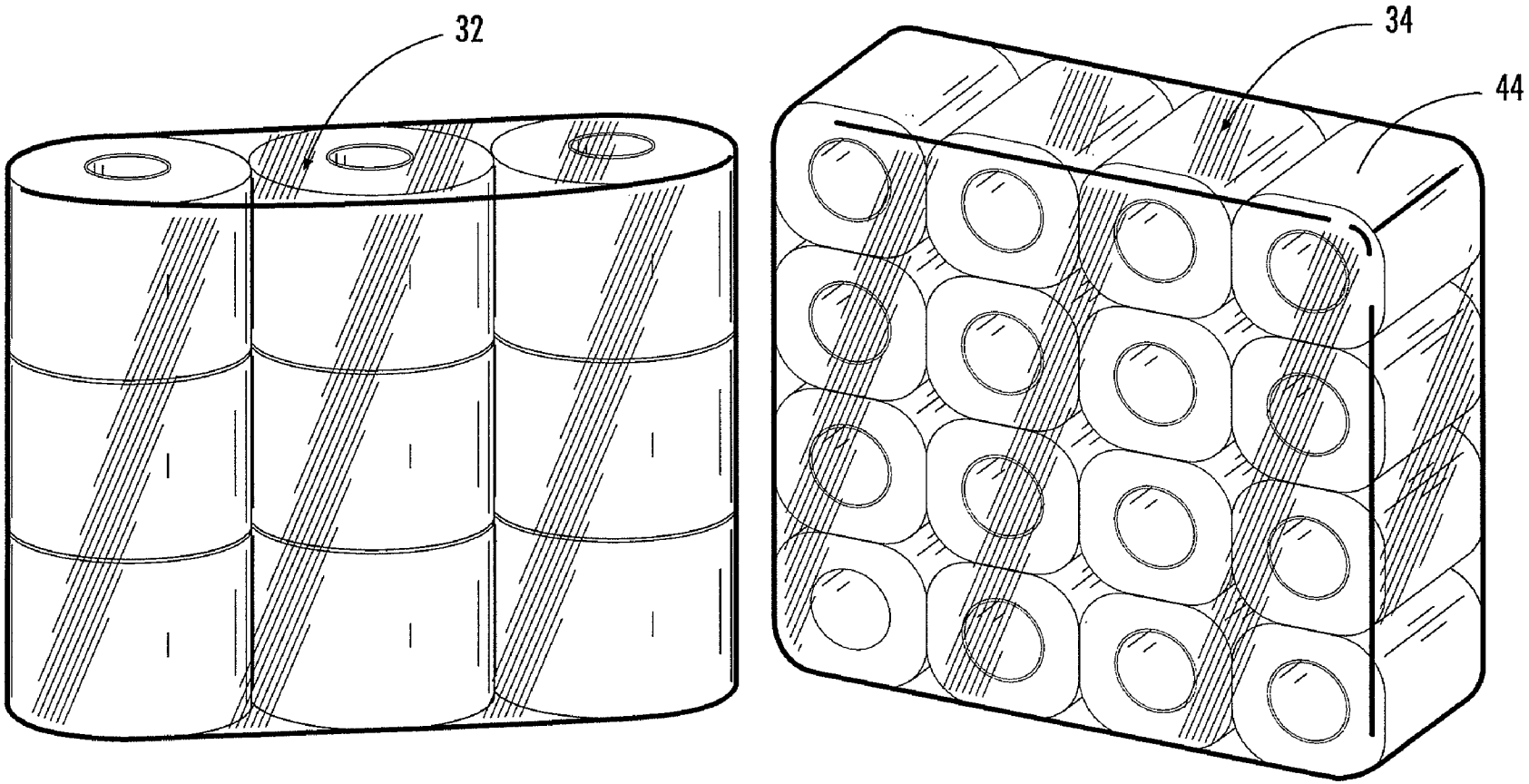

Having thus described the invention in general terms, reference will now be made to the accompanying drawings, which are not necessarily drawn to scale, and wherein:

FIGS. 1 and 1*a* are end views of a roll of material compressed in a radial direction according to one embodiment of the present invention;

FIG. 2 is a perspective view of an apparatus for compressing a roll of material positioned on a mandrel according to one embodiment of the present invention;

FIG. 2*a* is a perspective view of the apparatus shown in FIG. 2 compressing a roll of material;

FIG. 2*b* is a perspective view of an apparatus compressing a roll of material without a mandrel according to another embodiment of the present invention;

FIG. 2*c* is a perspective view illustrating an uncompressed roll of material, a compressed roll of material, and a compressed and packaged roll of material according to an embodiment of the present invention;

FIG. 3 is an end view of an array of rolls of material prior to compression according to an additional embodiment of the present invention;

FIG. 3*a* is an end view of the array of rolls of material shown in FIG. 3 and an array of rolls after radial compression according to one embodiment of the present invention;

FIG. 4 is a plan view of an apparatus for compressing a plurality of rolls of material according to an additional embodiment of the present invention;

FIG. 4*a* is a plan view of the apparatus shown in FIG. 4 in a position for compressing a plurality of rolls of material;

FIG. 4*b* is a perspective view of the apparatus shown in FIG. 4;

FIG. 5 is a plan view of an apparatus for compressing a plurality of rolls of material with a plurality of chucks according to an additional embodiment of the present invention; and FIG. 6 is a perspective view of an array of rolls of material packaged in an uncompressed form and an array of rolls of material packaged in a compressed form according to one embodiment of the present invention.

DETAILED DESCRIPTION OF THE INVENTION

The present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numbers refer to like elements throughout.

Referring now to the drawings and, in particular to FIGS. 1 and 1*a*, there is shown a roll of compressible material 10 compressed by a plurality of radial forces 14. As explained in further detail below, the roll 10 is configured to be radially and uniformly compressed to a reduced outer diameter without collapsing the inner core 12 of the roll.

The roll 10 may be individually compressed and packaged or packaged with a plurality of rolls as also explained below. Thus, the bulkiness of the roll 10 may be reduced in an aesthetically pleasing manner.

As used herein, the rolls 10 may comprise various materials that are capable of being compressed. For example, the roll 10 may comprise a paper, tissue, towel, or foam material wound about a core 12. The roll 10 may be compressed into various shapes, but would typically be compressed radially (i.e., perpendicular to the longitudinal axis of the core 12), as will be explained in further detail below. According to one embodiment, the roll 10 may comprise Through Air Dried tissue with an approximate density of 0.02 lbs/in$^3$ compressed by 30% of its original volume. However, the rolls 10 may comprise various materials and densities if desired. For example, the roll 10 could be compressed between 20-70% of its original volume. Moreover, the roll 10 may be configured to at least partially return to its original shape when the roll is unpackaged or the radial forces are otherwise removed from the roll.

As also used herein, the roll 10 may be packaged using any material and techniques capable of storing and maintaining the rolls in a compressed form. For example, the package may comprise any polymeric film or paper capable of storing the rolls 10 in a compressed form. Moreover, the packaging may be a box or similar container capable of storing one or more compressed rolls 10.

Each roll of material 10 may be wound about a respective core 12 or support tube. The core 12 is typically cylindrical in shape and has a hole with an inner diameter defined along its longitudinal axis, where the hole may receive a spindle of a dispenser or other mechanism for facilitating unrolling of the roll 10. The core 12 could be various materials such as a paper, foam, metallic, elastomeric, or thermoplastic material.

FIG. 2 illustrates an apparatus 16 for compressing a roll 10 of compressible material according to one embodiment of the present invention. The apparatus 16 includes a chuck 18 positioned about the roll 10 that is configured to move and radially compress the roll at a plurality of evenly spaced locations about the circumference of the roll such that the outer diameter of the roll is substantially uniformly reduced without collapsing the core 12. The radial forces 14 applied to the roll 10 may be directed towards the center of the roll 10 and generally perpendicular to the longitudinal axis of the roll and core 12. Thus, the apparatus 16 may be employed to compress the roll 10 without collapsing the core 12, which may include compressing the roll such that no stress concentrations are introduced into the core (e.g., evidenced by a permanent crease) and/or such that there is no substantial distortion of the original dimensions of the core (e.g., within about 10% of its original dimensions).

According to one embodiment, the chuck 18 includes a plurality of fingers 20 that are spaced about the circumference of the roll 10. As shown in FIG. 2, the fingers 20 may be longitudinal and disposed generally parallel to a longitudinal axis of the core 12. The fingers 20 may be about the same length as that of the roll 10, although the fingers could be various sizes and even configured to compress more than one roll simultaneously. In addition, FIG. 2 shows that each finger 20 may have a generally triangular cross section with the apex of the triangle configured to press against the outer surface of the roll 10. However, the fingers 20 may have various cross sections according to various aspects of the present invention and be configured to radially compress the roll (e.g., circular, square, or rectangular).

Each pair of fingers 20 is configured to apply an opposing radial force on the roll 10. For example, FIG. 2 demonstrates that there may be six fingers 20 such that three pairs of fingers may apply opposing radial forces on the roll 10. FIGS. 1 and 1*a* show that there could be four pairs of opposing radial forces 14 applied to the roll 10. Thus, there may any number of fingers 20 employed to radially compress the roll 10, such as between 4 and 10 fingers. In addition, there may be an odd or even number of fingers 20 that are evenly spaced about a roll and configured to radially and uniformly compress the roll 10 without collapsing the core 12. The chuck 18 could be actuated using various techniques known to those of ordinary skill in the art, such as with hydraulic or pneumatic power, to move the fingers 20 and apply a sufficient force on the roll 10 to compress the roll to a desired outer diameter.

The apparatus 16 may also include a mandrel 22 that is configured to be positioned at least partially within the core 12 and support the core while the roll 10 is radially compressed. Thus, the mandrel 22 may be generally cylindrical in shape and have an outer diameter that is slightly smaller than the inner diameter of the core 12. The mandrel 22 may be at least as long as the core 12 as shown in FIG. 2, but could be shorter than the core and be configured to engage the inner diameter of the core. In addition, the mandrel 22 may be of sufficient length to support a plurality of rolls. Thus, the mandrel 22 is sized and configured to be positioned within the core 12 and may be used to support the roll 10, such as during compression or packaging of the roll. The mandrel 22 may also help prevent distortion of the core 12 while the roll 10 is being radially compressed. However, the roll 10 may be uniformly radially compressed without the employ of a mandrel 22 since the radial forces evenly spaced about the circumference of the roll provide a uniform force about the core 12 that may prevent the core from collapsing (see FIG. 2*b*).

FIG. 2*a* shows the roll 10 being radially compressed by a plurality of fingers 20. When compressed, the roll 10 may have a generally "daisy-shaped" cross section, although the roll could have various cross sections depending on the type of chuck 20 used to radially compress the roll. FIG. 2*a* demonstrates that the fingers 22 may be configured to be at least partially embedded within the roll 10 while radially compressing the roll. Embedding the fingers 22 within the roll 10 may facilitate packaging of the roll while the roll is being compressed. For example, a packaging material could be circumferentially wrapped around the roll 10 while the fingers 22 are compressing the roll 10. Once the roll 10 has been packaged, the fingers may be displaced axially from their embedded position. As such, the roll 10 is capable of being packaged while being compressed, which reduces the possibility of the roll expanding prior to being packaged if the fingers 22 were first removed. Similarly, the mandrel 22 may remain positioned within the core 12 while the compressed roll 10 is packaged, or the mandrel could be removed prior to packaging. FIG. 2*c* illustrates an exemplary progression of an uncompressed roll 24, to a roll 26 radially compressed with the fingers 22, and to a compressed roll 28 that is packaged with a packaging material 30. FIG. 2*c* demonstrates that the core 12 remains substantially the same size following compression of the roll to a significantly reduced volume and is not collapsed.

According to one embodiment, the roll 10 is packaged using a heat-shrinkable film 44 such as, for example, a film comprising a polyolefin or a polyvinylchloride material. FIG. 6 shows an exemplary embodiment where an array 34 of compressed rolls 10 is packaged with a heat-shrinkable film 44. The heat-shrinkable film 44 could be wrapped circumferentially around the outer surface of the roll 10 either before or after the roll is compressed. Thus, the heat-shrinkable film 44 may be wrapped around the roll 10 so as to apply an inwardly directed radial force on the outer surface of the roll. The heat-shrinkable film 44 may be set in place using heat via convention, conduction, or radiation such that the film is capable of tightening around the roll 10 and maintaining the roll in its compressed form. The end user may simply remove the heat-shrinkable film 44 allowing the roll 10 to expand back to its original shape. According to one aspect, the heat-shrinkable film 44 is about 0.0001 to 0.010 inches in thickness and may be about 10 inches in width for wrapping circumferentially about the roll 10.

The rolls 10 may be radially compressed either independently or collectively as an array of rolls. For example, FIG. 3 depicts an array 32 of rolls 10 arranged in a plurality of rows prior to being radially compressed, while FIG. 3*a* shows an array 34 of rolls in a radially compressed form compared to the uncompressed array 32. Any number of rolls may be included in an array, such as a 4×4 array as shown in FIGS. 3 and 3*a*. Moreover, FIG. 6 shows the potential space savings for a 3×3 array 32 of uncompressed rolls and a 4×4 array 34 of compressed rolls that are packaged. In particular, FIG. 6 demonstrates that an array 34 of radially compressed rolls may result in an increase of 7 rolls for about the same sized packaging when compared to an array 32 of uncompressed rolls.

Various techniques could be employed to radially and uniformly compress an array 34 of rolls 10. For instance, FIGS. 4-4*b* and 5 illustrate exemplary embodiments of apparatus including means for radially compressing a plurality of rolls 10. In particular, the apparatus 36 shown in FIGS. 4-4*b* may include a first piston 38 and a second piston 40, as well as a plurality of mandrels 22 configured to be positioned within respective cores 12. The apparatus 36 may also include means for radially compressing each roll 10 such as a plurality of chucks 18. According to one embodiment, each chuck 18 may employ a plurality of fingers 20 as described above (see FIG. 5). Thus, each roll 10 may be independently radially compressed by a respective chuck 18. Upon being radially compressed, the pistons 38 and 40 may be configured to move in the y- and x-directions, respectively, which results in moving the chucks 18 and mandrels 22 such that the rolls 10 are arranged in an array and are positioned adjacent to one another as shown in FIG. 4*a*. When positioned adjacent to one another, the rolls 10 may be packaged such as by circumferentially wrapping the rolls into an array of rolls that are bundled together. Although the compressing machine 36 in FIG. 5 is shown as having sixteen chucks 16 and mandrels 22, any number of chucks and/or mandrels may be employed to compress a corresponding number of rolls 10 according to additional aspects of the present invention.

Furthermore, although the apparatus 36 has been described as radially compressing each roll 10 with a respective chuck 18 prior to positioning the rolls into an array, the apparatus could include various means for compressing a plurality of rolls, including an array of rolls. For example, an array 32 of rolls 10 (see e.g., FIG. 3) could be positioned within the apparatus 36, and the pistons 38, 40 could be equipped with walls 42 that may be moved concurrently in the x- and y-directions to radially compress the array 32 into an array 34 of rolls having a reduced volume (see FIG. 4*b*). The array 32 of rolls could be packaged either before or after being compressed. For instance, the array 32 could be wrapped circumferentially with a heat-shrinkable film 44 prior to being compressed and following compression, heat may be applied to the film to set the film in place.

Embodiments of the present invention may provide several advantages. For example, rolls 10 of compressible material, such as rolled tissue and towels, may be radially and uniformly reduced in volume which significantly reduces the inherent bulk of these products and facilitates the purchase, transport, and storage of the rolls. The inner core 12 of the roll 10 may not be collapsed or otherwise distorted. Thus, the compressed rolls 10 and cores 12 may be aesthetically pleasing, and the amount of packaging required to ship the rolls of material from a manufacturing facility to a retailer may be reduced. The rolls 10 may be formed consistently into regular shapes such that handling and storage of the rolls, such as by stacking multiple packages of rolls, is improved. When removed from the packaging, the compressed rolls 10 of material may readily expand to a usable form. Moreover, embodiments of the present invention may be suitable for high volume throughput applications, such as having the ability to compress ten or more rolls 10 per second.

Many modifications and other embodiments of the invention set forth herein will come to mind to one skilled in the art to which the invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

A. A method for compressing at least one roll of compressible material, the method comprising:

providing at least one roll having an outer diameter and an inner core having an inner diameter;

positioning a mandrel within the inner diameter of the inner core prior to compressing the at least one roll; and radially compressing the at least one roll while the mandrel is positioned within the inner core such that the outer diameter of the at least one roll is substantially uniformly reduced without collapsing the inner core.

B. The method of Claim A, further comprising at least partially enclosing the at least one roll with a packaging material either before or after radially compressing the at least one roll.

C. The method of Claim B, wherein enclosing the at least one roll comprises circumferentially wrapping the at least one roll with a packaging material.

D. The method of Claim C, wherein enclosing comprises at least partially enclosing the at least one roll with a heat-shrinkable film and applying heat to the heat-shrinkable film.

E. The method of Claim A, wherein radially compressing the at least one roll comprises radially compressing the at least one roll with a pair of opposing forces at a plurality of radial locations.

F. The method of Claim A, further comprising providing a plurality of rolls each having an outer diameter and an inner core having an inner diameter and radially compressing the plurality of rolls such that the outer diameter of each of the plurality of rolls is substantially uniformly reduced without collapsing the inner diameter of a respective core.

G. The method of Claim F, further comprising positioning a mandrel within each core prior to radially compressing the plurality of rolls.

H. The method of Claim F, further comprising arranging the plurality of rolls in an array of rows either before or after radially compressing the plurality of rolls.

I. The method of Claim A, wherein radially compressing comprises radially compressing the at least one roll to a volume that is at least 25% less than its original volume.

J. The method of Claim A, wherein radially compressing comprises radially compressing the at least one roll in a direction generally perpendicular to a longitudinal axis of the core.

K. An apparatus for compressing at least one roll of compressible material having an outer diameter and a circumference and an inner core having an inner diameter, the apparatus comprising:

a chuck configured to move and radially compress the at least one roll such that the outer diameter of the roll is substantially uniformly reduced without collapsing the inner core; and at least one mandrel configured to be positioned at least partially within the inner diameter of the inner core and to support the inner core while the at least one roll is radially compressed.

L. The apparatus of Claim K, wherein the chuck is configured to be positioned about the circumference of the at least one roll and engage the at least one roll at a plurality of evenly spaced locations about the circumference of the at least one roll.

M. The apparatus of Claim K, further comprising a plurality of chucks configured to radially compress a plurality of rolls of material.

N. The apparatus of Claim M, further comprising a plurality of mandrels each configured to be positioned within a respective inner core.

O. The apparatus of Claim M, wherein each of the plurality of chucks is configured to be positioned about a respective roll and to move and radially compress a respective roll.

P. The apparatus of Claim M, wherein each chuck is configured to radially compress a respective roll independently.

Q. The apparatus of Claim N, wherein the plurality of chucks and mandrels are configured to move such that the plurality of rolls are positioned adjacent to one another in an array of rows.

R. The apparatus of Claim K, wherein the chuck is configured to radially compress the at least one roll in a direction generally perpendicular to a longitudinal axis of the inner core.

That which is claimed:

1. A method for compressing a roll of compressible material having an outer diameter and a circumference and an inner core having an inner diameter, the method comprising:

positioning a chuck about the circumference of the roll, wherein the chuck is configured to engage the roll at a plurality of evenly spaced locations about the circumference of the roll; and radially compressing the roll at a plurality of evenly spaced locations about the circumference of the roll with the chuck such that the outer diameter of the roll is substantially uniformly reduced without collapsing the inner core and the roll is independently radially compressed by the chuck.

2. The method of claim 1, further comprising positioning a mandrel within the inner diameter of the inner core prior to compressing the roll.

3. The method of claim 1, further comprising at least partially enclosing the roll with a packaging material either before or after radially compressing the roll.

4. The method of claim 3, wherein enclosing the roll comprises circumferentially wrapping the roll with a packaging material.

5. The method of claim 4, wherein enclosing comprises at least partially enclosing the roll with a heat-shrinkable film and applying heat to the heat-shrinkable film.

6. The method of claim 1, wherein radially compressing the roll comprises radially compressing the outer diameter of the roll with a pair of opposing forces at a plurality of radial locations evenly spaced about the circumference of the roll.

7. The method of claim 1, further comprising providing a plurality of rolls each having an outer diameter and an inner core having an inner diameter and radially compressing the plurality of rolls such that the outer diameter of each of the plurality of rolls is substantially uniformly reduced without collapsing the inner diameter of a respective core; positioning a plurality of chucks about the circumference of each of the respective rolls, wherein each of the chucks are configured to engage each of the respective rolls at a plurality of evenly spaced locations about the circumference of each of the respective rolls; and radially compressing each of the respective rolls at a plurality of evenly spaced locations about the circumference of each of the respective rolls with one of the respective chucks such that the outer diameter of each of the respective rolls are substantially uniformly reduced without collapsing the inner core and each roll is independently radially compressed by a respective chuck.

8. The method of claim 7, further comprising positioning a mandrel within each inner core prior to radially compressing the plurality of rolls.

9. The method of claim 7, further comprising arranging the plurality of rolls in an array of rows either before or after radially compressing the plurality of rolls.

10. The method of claim 1, wherein radially compressing comprises radially compressing the roll to a volume that is at least 25% less than its original volume.

11. The method of claim 1, wherein radially compressing comprises radially compressing the roll in a direction generally perpendicular to a longitudinal axis of the core.

12. An apparatus for compressing roll of compressible material having an outer diameter and a circumference and an inner core having an inner diameter, the apparatus comprising:

a chuck configured to engage the roll at a plurality of radial locations evenly spaced about the circumference of the roll and to move and radially compress the roll such that the outer diameter of the at least one roll is substantially uniformly reduced without collapsing the core, wherein the chuck comprises a plurality of fingers configured to engage the roll at a plurality of radial locations evenly spaced about the circumference of the roll and to move and radially compress the roll.

13. The apparatus of claim 12, further comprising at least one mandrel configured to be positioned at least partially within the inner diameter of the inner core and support the inner core while the roll is radially compressed.

14. The apparatus of claim 12, wherein the chuck comprises at least four fingers, wherein a first pair and a second pair of fingers are configured to move and apply opposing radial forces on the roll to radially compress the at least one roll.

15. The apparatus of claim 12, wherein the plurality of fingers are longitudinal and are disposed generally parallel to a longitudinal axis of the core.

16. The apparatus of claim 12, wherein the plurality of fingers are configured to be at least partially embedded within the roll while radially compressing the roll.

17. The apparatus of claim 12, wherein the plurality of fingers are configured to radially compress the roll in a direction generally perpendicular to a longitudinal axis of the core.

18. The apparatus of claim 12, comprising a plurality of chucks, each configured to engage a respective roll, wherein each chuck comprises a plurality of fingers configured to engage and radially compress a single roll such that each roll is independently radially compressed by the plurality of fingers.

* * * * *